US005791207A

United States Patent [19]

Ahdoot

[11] Patent Number: 5,791,207

[45] Date of Patent: Aug. 11, 1998

[54] FASTENER FEEDER

[76] Inventor: Ned M. Ahdoot, 6916 Kings Harbor Dr., Rancho Palos Verdes, Calif. 90275

[21] Appl. No.: 799,147

[22] Filed: Feb. 14, 1997

[51] Int. Cl.[6] ..... B25B 23/06

[52] U.S. Cl. ..... 81/57.37; 81/452

[58] Field of Search ..... 81/57.37, 451, 81/452

[56] References Cited

U.S. PATENT DOCUMENTS

| | | | |
|---|---|---|---|
| 3,056,441 | 10/1962 | Helms | 81/452 X |
| 4,258,598 | 3/1981 | Hoffmann | 82/38 R |
| 4,295,394 | 10/1981 | DeCaro | 81/57.37 |
| 5,138,913 | 8/1992 | Chen | 81/434 |
| 5,167,174 | 12/1992 | Fujihama et al. | 81/434 |
| 5,341,706 | 8/1994 | Takagi | 81/434 |
| 5,660,090 | 8/1997 | Deri | 81/57.37 X |

*Primary Examiner*—James G. Smith

*Attorney, Agent, or Firm*—Gene Scott - Patent Law & Venture Group

[57] ABSTRACT

A fastener feeding apparatus provides an aperture for inserting fasteners into the interior of the apparatus so that the fastener lies on the longitudinal axis of the apparatus. A bit is then forced into contact with the fastener in order to engage it for mutual rotation and translation. A set of flexible leaves are preformed to press inwardly against the shank of the fastener so as to maintain its axial orientation. The bit is driven to force the fastener to move through the apparatus while rotating. The leaves move radially outwardly to accommodate the head of the fastener.

5 Claims, 2 Drawing Sheets

FASTENER FEEDER

BACKGROUND OF THE INVENTION

1. Field of the Invention

This invention relates generally to screw feeding devices and more particularly to an improved screw holder and feeder.

2. Description of Related Art

Invention and use of automatic screw feeding machines are known to the public. For instance, Fujiyama et al. U.S. Pat. No. 5,167,174 discloses a screw driving machine with a magazine for supporting a belt which holds screws that are to be driven. The magazine also serves to guide the belt and screws into an operating position. The magazine is of a semi-elliptical shape and incorporates a guide passage. Hoffmann U.S. Pat. No. 4,258,508 discloses a collet rotatably mounted in the tool bracket of a Swiss-type automatic screw machine. The device is assembled with a mechanism for contracting the collet to grip the work with sufficient force to cause the collet to rotate with the work but yet enable the work to translate axially through the collet as it is advanced or retracted by the rotating head stock of the screw machine. Takagi U.S. Pat. No. 5,341,706 discloses a screw-driving device which drives screws continuously in sequence. The device has a casing coupled to a screwdriver, a slide member slidably moved in reciprocating movement in the casing and a mechanism for feeding a screw-holding tape. The tape feeding mechanism includes a guide slot provided in the casing, and a two-arm lever pivotally connected to the slide member and pivotally moved to perform indexing of the screws to a position aligned with the screwdriver by a pin fitted into the inclined section of the guide slot. A pawl member with a pawl fitted into one of the grooves at one lateral edge of the tape is pivotally connected to the end of the other arm of the two-arm lever and is biased toward the tape by a spring. At the same time, a further pawl member entering one of the grooves at the opposite side of the tape is pivotally connected to the slide member and is biased toward the tape. Chen U.S. Pat. No. 5,138,913 discloses an automatic screw mechanism that includes a connector plate mounted on a rear open end of a hollow casing. The connector plate has a central opening to receive one end of an automatic screw driving device. A guide member has a front end extending out of a front open end of the casing to be placed against an operating surface. The casing is slidably mounted on the guide member. An axial seat is provided in the guide member and defines an axial opening of the connector plate. The axial seat has a ratchet wheel rotatably provided on one side. A feed belt extends into the guide member in front of the axial seat. The ratchet wheel engages the feed belt so as to align a first screw of the feed belt with the axial opening. A spring connects the axial seat and connector plate. The spring is compressed when the casing is urged by the screw driving device to move from an initial position to a second position, wherein the tool bit extends into the axial opening to rotatably drive the first screw into the operating surface. The ratchet wheel is rotated by a predetermined angular rotation when the casing moves back to the initial position after a screw driving operation so that the ratchet wheel can align a second screw with the axial opening.

However, many of these devices are designed to accept a plurality of screws bound by a screw-holding tape. Thus, in order for such devices to be utilized, a pre-manufactured screw-holding tape must be purchased. Thus there is a need for a screw driving device in which the screws can be manually loaded into the device, so that no tape supply is required, and so that different screws can be loaded at will; for instance, differently colored or ornamented screws or slotted vs phillips-head types, etc. as each individual application requires. A simple manually loaded screw holder-feeder fulfills the need for a less costly, loss problematic and more reliable handy-mans helper. The present invention fulfills these needs and provides further related advantages as described in the following summary.

SUMMARY OF THE INVENTION

A cylindrical fastener feeding apparatus provides an aperture in its side wall for inserting a fastener into the interior of the apparatus so that the fastener lies on the longitudinal axis of the apparatus. A bit is then forced into contact with the fastener in order to engage it for mutual rotation. A set of flexible leaves are preformed to press inwardly against the shank of the fastener so as to maintain its axial orientation. While rotating, the bit is driven longitudinally to force the fastener to move through the apparatus while rotating. The leaves are pushed by the fastener, radially outwardly to accommodate the head of the fastener. The fastener moves out of one end of the apparatus disengaging itself from the bit when it has been secured in the workpiece. Thus it is an object of the present invention to provide a fastener driver that holds a fastener, engages a drive tool with the fastener and guides the fastener into the workpiece while rotating the fastener. It is a further object to provide such an apparatus capable of accepting fasteners over a range of sizes and shapes. It is a further object to provide such an apparatus that is simple in construction and therefore inexpensive to provide on a commercial basis. It is a final object to provide such an apparatus that is very simple to use so that an unskilled person may easily take advantage of the benefits provided by the apparatus, and without the danger of injury.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for driving a fastener. In such drawings.

DETAILED DESCRIPTION OF THE PREFERRED EMBODIMENT

Figure 1:
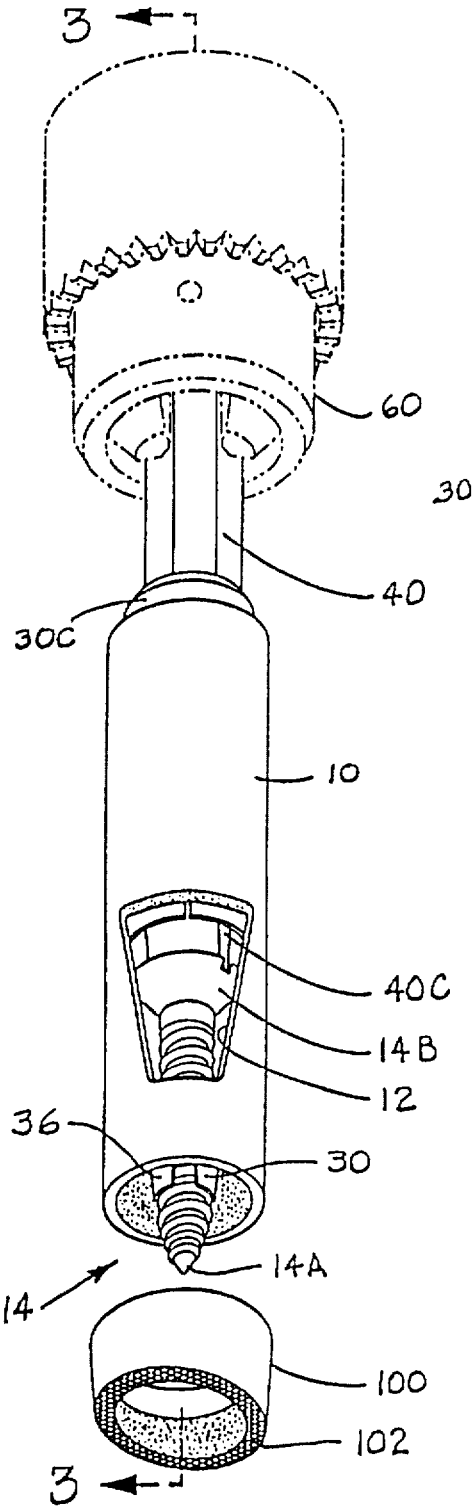
FIG. 1 is a perspective view of the preferred embodiment of the present invention, particularly showing a side wall aperture, shown here as a tapered opening, through which a fastener is loaded into the device, the manner in which the fastener is held within the apparatus by a fastener guide preformed spring and a angle adapter for driving screws at a set angle into a planar workpiece.

The invention is a fastener handling and feeding apparatus. As shown in the drawings, and particularly, FIG. 1, it includes a cylindrically shaped shell 10 of a rigid structural material such as aluminum or steel. The shell 10 provides opposing shell open ends 1OA and 1OB and a shell side wall 1OC. Positioned in the side wall is a shell aperture 12 large enough for accepting the passage of an elongated fastener 14, such as a screw or bolt, which is pushed through into the shell aperture 12 for loading the fastener 14 into the apparatus. The aperture 12 is preferably narrower at one end so as to accept the shank 14A of the screw first, followed by the screw head 14B.

Figure 2:
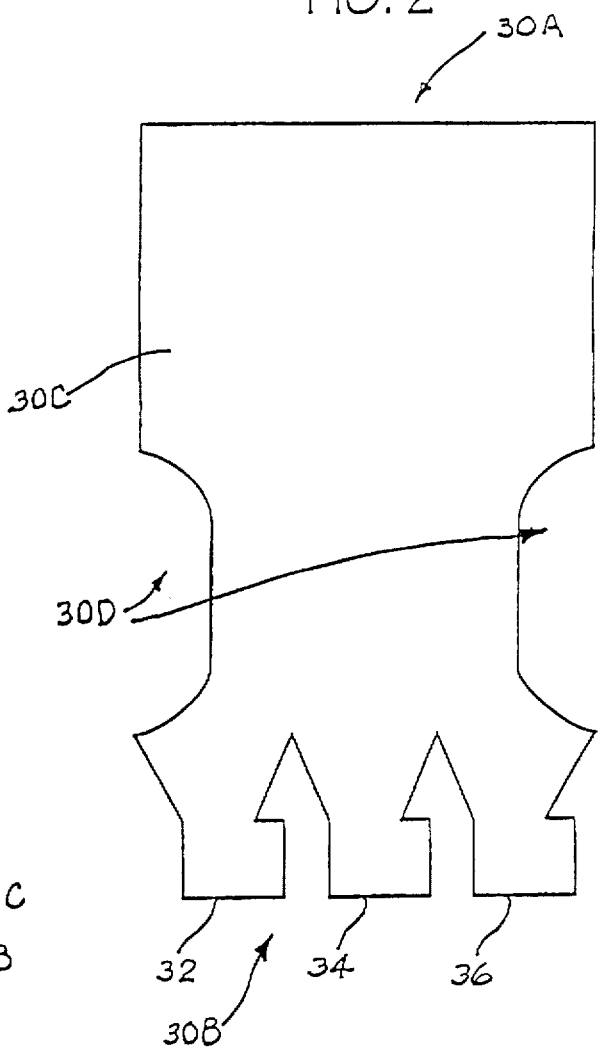
FIG. 2 is an elevational view of a fastener guide preformed spring of the invention shown as a flat plate prior to being rolled into a funnel shaped cylinder and heat treated into a spring.
Figure 3:
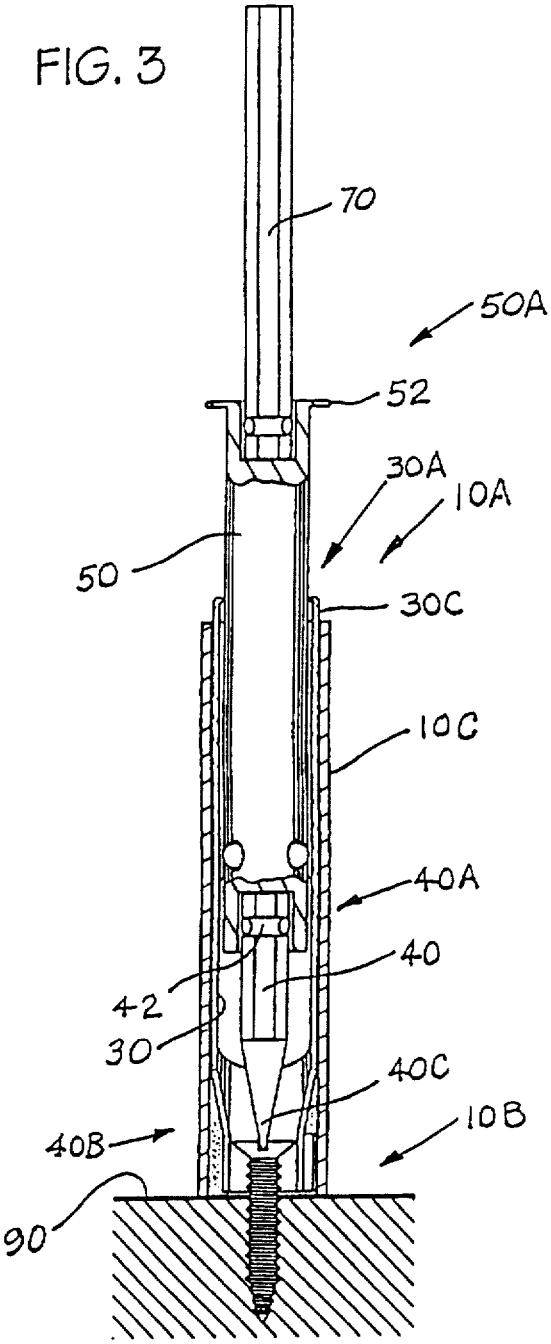
FIG. 3 is a cross-sectional view of the invention taken along line 3—3 in FIG. but rotated by 90 degrees so that the aperture, shown here as a oblong opening, appears at the rear of the view for clearity, and in which a drive tool is shown in a position for engaging the fastener and having driven the fastener part-way into the workpiece.
Figure 4:
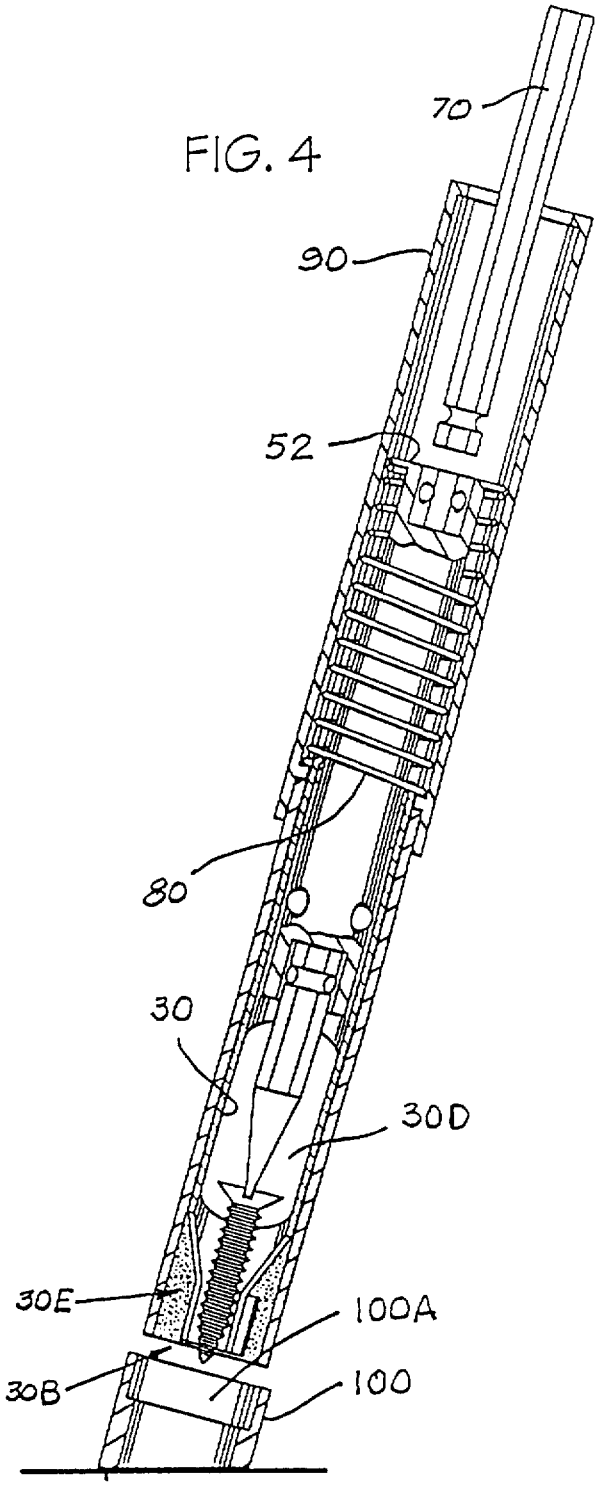
FIG. 4 is a view similar to FIG. 3 and further showing the angle adapter of FIG. 1 and a spring means by which the apparatus recovers its original state after driving a fastener; again, the fastener being shown as it has been started to be driven downwardly.

A generally cylindrically shaped, thin walled, fastener guide 30 is shown as a flat plate in FIG. 2. When rolled into a cylindrical shape, the guide 30 easily fits within the shell 10 as shown in FIGS. 3 and 4. It provides opposing guide open ends 30A and 30B and a guide side wall 30C. The guide side wall 30C has a guide aperture 30D, (FIGS. 2 and 4) which is preferably aligned with the shell aperture 12, and is also capable of accepting the passage of the elongated fastener 14. The open end 30B of the side wall 30C is separated into plural leaves 32, 34, and 36, preferably three, although four or five leaves may be used. These leaves may best be seen in FIG. 2. Each of the leaves 32, 34, 36 is tapered toward the common open end 30B of the guide 30 and is spring tempered in a funnel shape 30E as best seen in FIG. 4. The guide wall 30C and shell wall 10C are fixedly engaged adjacent to the guide's open end 10A so that the guide and shell remain in a fixed relative longitudinal position with respect to each other. Such engagement may be by frictional engagement, by bonding or other attachment means well known in the art so that it is not further defined or shown here.

As the screw 14 is inserted through this apertures 12 and 30D, it is automatically aligned with the axis of shell 10 and guide 30 as shown in FIGS. 3 and 4. Beside being aligned longitudinally, the shank 14A of screw 14 is engaged with leaves 32, 34, and 36 which press radially inwardly against the screw shank 14A to hold the screw coaxially within the guide 30.

An elongate driver bit 40 has, at one end 40A a means for engagement 42 with a sliding drive tool 50. Such an engagement means 42 is preferably a hexagonal cross-sectional shape and a circumferential concave groove encircling the driver bit as is well known in the art. At the other end 40B of the driver bit 40 is provided a means for engaging 40C the driver bit 40 with the head 14B of the fastener 14, for example, a slotted screw driver blade, or a Phillips screw driver configuration, also well known in the art. The sliding drive tool 50 preferably has a diameter suitable for axial sliding engagement within the guide side wall 30C. The driver bit 40 is removably engaged with the sliding drive tool 50 and extends into the guide 30, initially above the apertures. The sliding drive tool 50 moves axially into the guide 30 in order to push the fastener 14 through the end 10B of shell 10.

In the embodiment of FIG. 1, the driver bit 40 is engaged with a rotary device 60, such as a power or manual drill, directly. In an alternate embodiment, not shown, the sliding drive tool 50 may be engaged by the rotary device 60. In the embodiment shown in FIGS. 3 and 4, the sliding drive tool 50 is driven by an extension or adapter tool 70 which is driven by such the rotary device 60. As shown in FIGS. 3 and 4, such an adapter tool 70 may be engaged with the sliding drive tool 50 in a similar manner as is the attachment method of the driver bit 40 to the sliding drive tool 50.

As shown in FIG. 4, a coil spring 80 may be mounted such that it is coaxial with the sliding drive tool 50, the drive tool moving within the spring 80. An annular lip 52 formed at one end 50A of the drive tool 50 captures the spring 80 between the lip 52 and the shell 10 so that as the drive tool 50 moves into the shell 10 the spring 80 is compressed as shown in FIG. 4. When the sliding drive tool 50 is thereafter released, the spring 80 extends, forcing the drive tool 50 back to its uppermost position.

With the apparatus engaged in the rotary device 60 as described above, the fastener 14 is then inserted through the apertures 12 and 30D into the fastener guide 30. The leaves 32, 34, 36 press inwardly against the fastener 14 as shown best in FIGS. 1 and 4 thereby supporting the fastener 14 aligned with axis of the apparatus. The end 10B of the shell 10 is placed squarely against a work surface 90 as shown in FIG. 3. The driver bit 40 is then moved downwardly axially into contact and engagement with the fastener 14. As the driver 40 is pushed into the fastener guide 30, it forces the fastener to move through the fastener guide and causes the leaves 32, 34 and 36 of guide 30 to move radially outwardly to accommodate fastener passage as is best shown in FIG. 3. The rotary device 60 rotates the sliding drive tool 50, driver bit 40 and fastener 14 such that it may be driven into the workpiece surface 90. The length of drive tool 50 provides a means for limiting the slidable displacement of the driver bit 40 so as to limit screw 14 displacement into workpiece surface 90. Other known means for limiting screw travel may be used in conjunction with the invention and as such will be in keeping with the spirit and objectives of the invention. A limitation to displacement travel is highly desirable in, for instance, applications such as fastening dry-wall panels to building studs. In such applications it may be desirable to have the driven end of the screw 14 flush with the workpiece surface 90 or slightly below the surface 90.

After driving the fastener 14 into the workpiece, the sliding drive tool 50 and driver bit 40 are withdrawn manually, as in FIG. 3, or automatically by the spring 80 to an upward position for clearing the apertures 12 and 30D whereby another fastener 14 has clearance to be inserted into the guide 30. The driver bit 40 may be changed by simply pulling the present driver bit 40 out of the sliding drive tool 50 and inserting a different driver bit 40. As shown in FIG. 4, a spring housing 90 may be used to enclose spring 80.

Angle adapter 100 provides an engagement counterbore 100A for accepting the shell 10 in friction engagement so that the adapter 100 is fixed to the end 10B of shell 10. Adapter 100 further includes an annular angular-cut lower rim 102 providing a base for positioning the apparatus at a desired angle for driving the fastener into the workpiece at said desired angle.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A fastener feeding apparatus for feeding a fastener so that the fastener may be driven into a workpiece, the apparatus comprising:

a cylindrically shaped shell of a rigid structural material, the shell providing a shell side wall having a shell aperture of a size for accepting passage of the fastener therethrough;

within the shell and fixed in place therein, a generally cylindrically shaped, thin walled, fastener guide of a spring temper material, the guide providing a guide side wall having a guide aperture of a size for accepting the passage of the fastener therethrough, and plural leaves converging toward a common open end of the guide side wall, the leaves operable for engaging the fastener for holding the fastener coaxially within the guide and shell;

a rod shaped driver bit having at one end a means for driving the fastener, and at the other end thereof, a means for engaging a rotary device, the driver bit being rotatable while being slidably displacable within the fastener guide for driving the fastener out of one end of the shell into the workpiece.

2. The apparatus of claim 1 further including a driver tool slidably engaged within the guide and further engagable with the drive bit such that the drive bit may be easily replaced.

3. The apparatus of claim 2 further including a spring engaged with the driver tool so as to be compressed as the fastener is driven and to reset the driving tool thereafter.

4. The apparatus of claim 1 further including an angle adapter comprising an annular wall having an engagement counterbore for accepting the shell in friction engagement so that the adapter is fixed to the end of shell and further including an annular angular-cut lower rim providing a base for positioning the apparatus at a desired angle for driving the fastener into the workpiece at said desired angle.

5. The apparatus of claim 1 further including a means for limiting the slidable displacement of the driver bit, so as to limit screw displacement.

* * * * *